United States Patent [19]

Pettis, Jr.

[11] 4,127,064

[45] Nov. 28, 1978

[54] LARGE TYPE ROTARY PRINTER

[75] Inventor: Charles R. Pettis, Jr., Ithaca, N.Y.

[73] Assignee: Hi-Speed Checkweigher Co., Inc., Ithaca, N.Y.

[21] Appl. No.: 777,108

[22] Filed: Mar. 14, 1977

[51] Int. Cl.[2] ..... B41J 1/46

[52] U.S. Cl. ..... 101/93.18; 101/110; 64/30 E; 64/30 C; 400/169; 400/162

[58] Field of Search ..... 197/18.55, 49, 6.4; 101/99, 110, 269, 93.22, 93.47; 64/27 F, 30 C, 30 E

[56] References Cited

U.S. PATENT DOCUMENTS

| | | | |
|---|---|---|---|
| 2,845,019 | 7/1958 | Stiefel | 197/18 |
| 2,956,656 | 10/1960 | Becksted | 60/30 C |
| 3,015,265 | 1/1962 | Greiner | 101/110 |
| 3,083,641 | 4/1963 | Childs | 101/110 |
| 3,797,386 | 3/1974 | Dean et al. | 101/99 |
| 3,837,457 | 9/1974 | Anglin et al. | 197/55 |
| 3,859,509 | 1/1975 | Dillingham et al. | 101/269 |
| 3,872,789 | 3/1975 | Ambrosio | 197/18 |
| 3,889,592 | 6/1975 | Lupkas et al. | 101/93.47 |
| 3,989,000 | 11/1976 | Foley, Jr. | 64/30 E |
| 4,019,110 | 4/1977 | Gerry | 197/53 |

OTHER PUBLICATIONS

Davis et al., "Label Imprinter" IBM Technical Disclosure Bulletin, vol. 16, No. 4, p. 1149, 9/73.

*Primary Examiner*—William Pieprz

[57] ABSTRACT

A large type printer which continuously drives annular printing wheels having circumferentially spaced printing facets on their peripheries. The driving mechanism is a friction drive which may be overriden. Thus, the apparatus includes means for monitoring the rotational positions of each of the printing wheels and for stopping the rotation of the individual printing wheels when the respective facets are in printing position.

18 Claims, 5 Drawing Figures

LARGE TYPE ROTARY PRINTER

BACKGROUND OF THE INVENTION

1. Field of the Invention

This invention relates to a rotary printer. More specifically, this invention relates to a printer of labels having large characters for packing cases or the like.

2. Description of the Prior Art

In a label printing unit such as, for example, disclosed in U.S. Pat. No. 3,951,061, issued Apr. 20, 1976, a plurality of adjacent print wheels carrying peripherally mounted printing facets are intermittantly rotated by a stepping motor until the desired facet is in printing position. When an individual facet is in the appropriate printing position, one of a number of hammers is actuated to strike the label to be printed to force the label and an inked tape into contact with the facet. Subsequently, the printing wheels are driven in continued intermittant fashion with other hammers being selectively actuated until the label has been printed, at which point the label is removed and a new label inserted into the printing position. U.S. Pat. No. 3,973,488, issued Aug. 10, 1976 also discloses a label printing device which causes printing wheels to be intermittantly rotated. In this case, however, the printing wheel itself acts as the hammer and is moved in a manner which brings its facet into contact with an inked tape and the label to be printed.

These and similar prior devices are extremely complicated devices requiring many precisely synchronized intricate moving parts. As such, they are expensive to manufacture and are subject to operation difficulties brought about through wear of the multiple parts. In addition, each of these devices operates in a manner in which the label is repeatedly struck at different times in different places until all of the desired information is printed. This mode of operation creates the possibility of movement of the label resulting in blurred or out of line characters or in two characters being superimposed. It is desirable therefore to have a printing device which aligns all of the character printing facets and prints all of the characters at one time. It is also desirable to provide a label printing device which is relatively simple in operation, which has few intricate moving parts, and which dispenses with such expensive parts as accurate stepping motors. It is still further desirable to provide a label printing device which may readily be scaled up in size in order to obtain a large label printing device for warehouse crates, for example, without incurring undue expense.

SUMMARY OF THE INVENTION

The above mentioned and other disadvantages are alleviated by the present invention which includes a plurality of annular printing cylinders having peripherally mounted printing facets. Each of the printing cylinders is rotationally mounted on a plurality of continuously driven drive shafts. Friction means mounted on the drive shafts engage the printing cylinders to impart rotation thereto. The friction means are capable of permitting slippage between the drive shafts and the printing cylinders when the printing cylinders are prevented from rotating.

Means are provided for engaging the printing cylinders so that when actuated, rotation of an individual cylinder is halted. Each of the cylinder engaging means is actuated in response to a cylinder position sensor and in response to an information input device so that rotation of the cylinders can be halted with the desired facets in position ready for printing. Also included are a number of interlock devices and switches which control the overall operation of the systems so that the label is not prematurely moved toward the printing cylinders while the cylinders are still rotating and so that the cylinders themselves do not start to rotate after a printing operation until the label has been removed to a withdrawn position.

BRIEF SUMMARY OF THE DRAWINGS

The present invention may be better understood and its numerous objects and advantages will become apparent to those skilled in the art by reference to the accompanying drawings wherein like reference numerals refer to like elements in the several figures and in which.

DESCRIPTION OF THE PREFERRED EMBODIMENT

Figure 1:
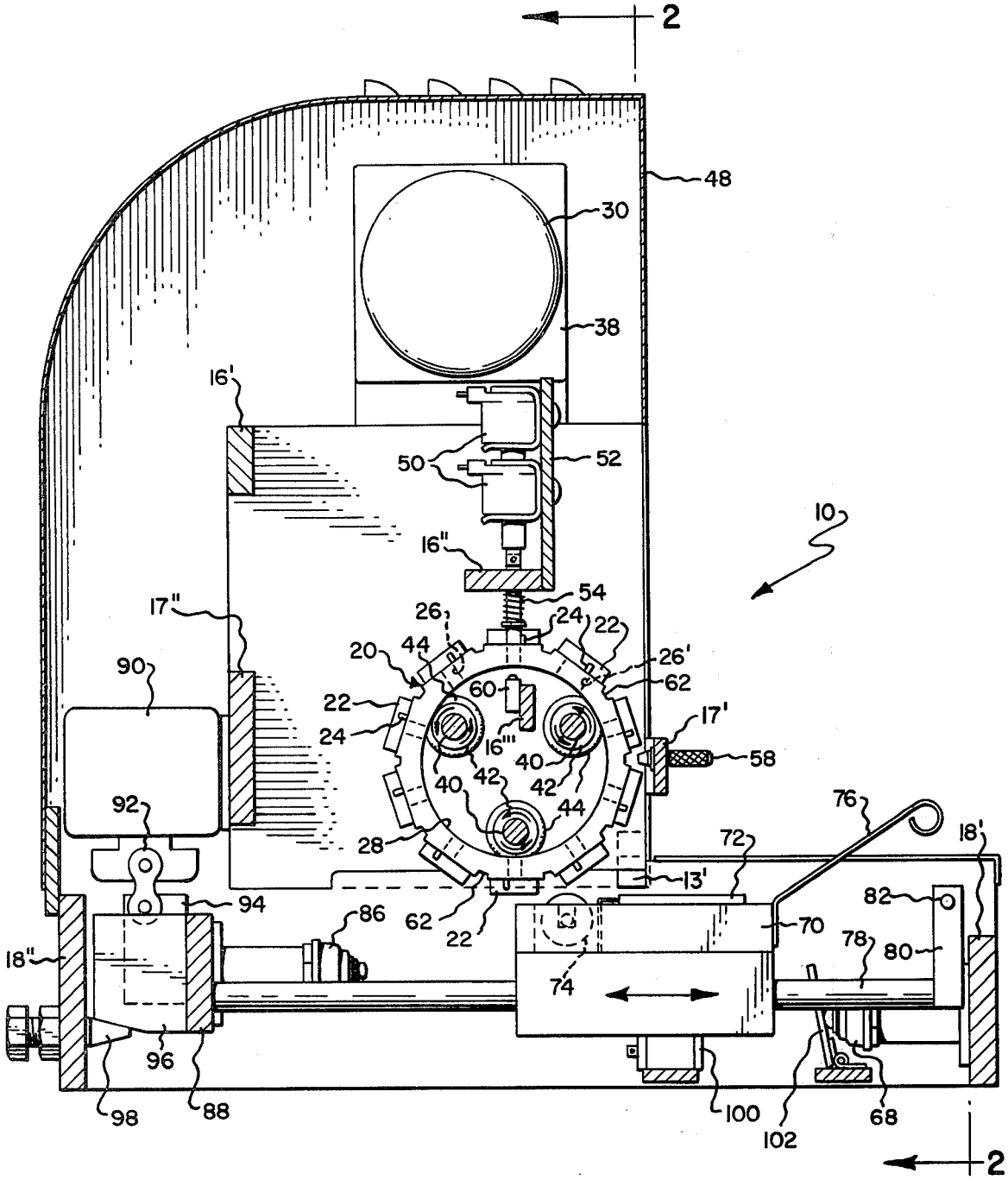
FIG. 1 is a cross-sectional side view of the label printing device of the present invention.
Figure 2:
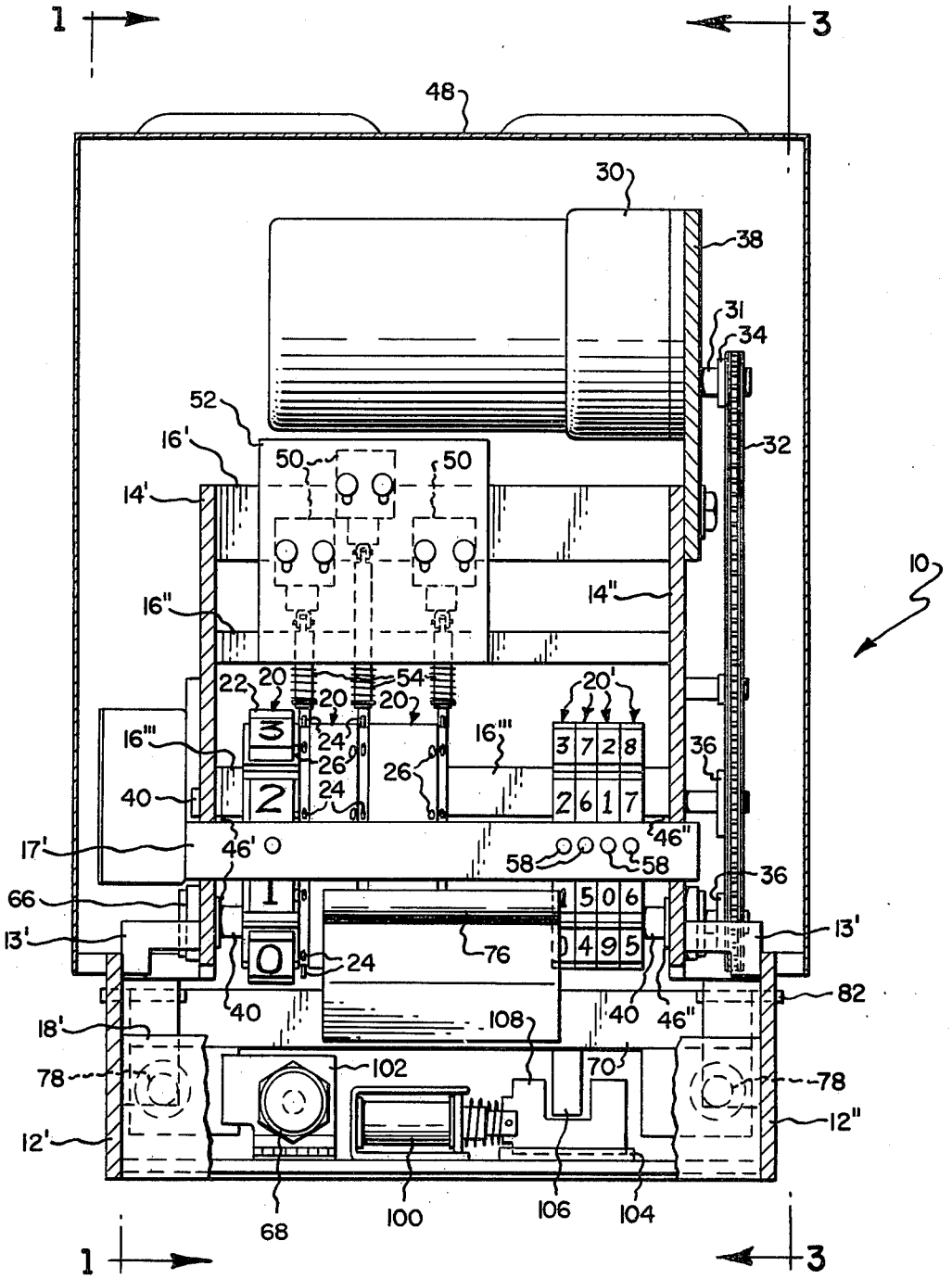
FIG. 2 is a view of the printing device taken along the view lines 2—2 of FIG. 1.

Referring now to FIGS. 1 and 2, the rotary printer of the invention is illustrated generally at numeral 10. The structural framework for the rotary printer 10 consists of a basically rectangular assemblage of structural members. The base of the unit includes lengthwise pieces 12′ and 12″ connected at their ends by transverse pieces 18′ and 18″ respectively to create a rectangular box-like base structure. Upstanding side plates 14′ and 14″ are attached to and are supported from the lower rectangular base members 12′ and 12″ by structural members 13′ and 13″. Transverse structural support tie bars 16′, 16″ and 16‴, 17′ and 17″ span the distance between and are fastened to side plates 14′ and 14″. Motor 30 is mounted on a motor-mount plate 38 which in turn is mounted on structural side plate 14″.

Drive motor 30 drives shaft 31 and chain sprocket 34. Chain 32 engages sprocket 34 and acts as the driving connection between sprocket 34 and a plurality of sprockets 36. Chain sprockets 36 are mounted on three driven shafts 40, each of which traverse the space between the side support plates 14′ and 14″ and are rotationally mounted by means of bearings 46′ and 46″. As can be seen from FIG. 2, the axis of rotation of the driven shafts 40 are parallel to one another. Additionally, chain 32 is fed over chain sprockets 36 so that all three of the driven shafts 40 are caused to continuously rotate in the same direction by the driving force provided by motor 30.

Figure 3:
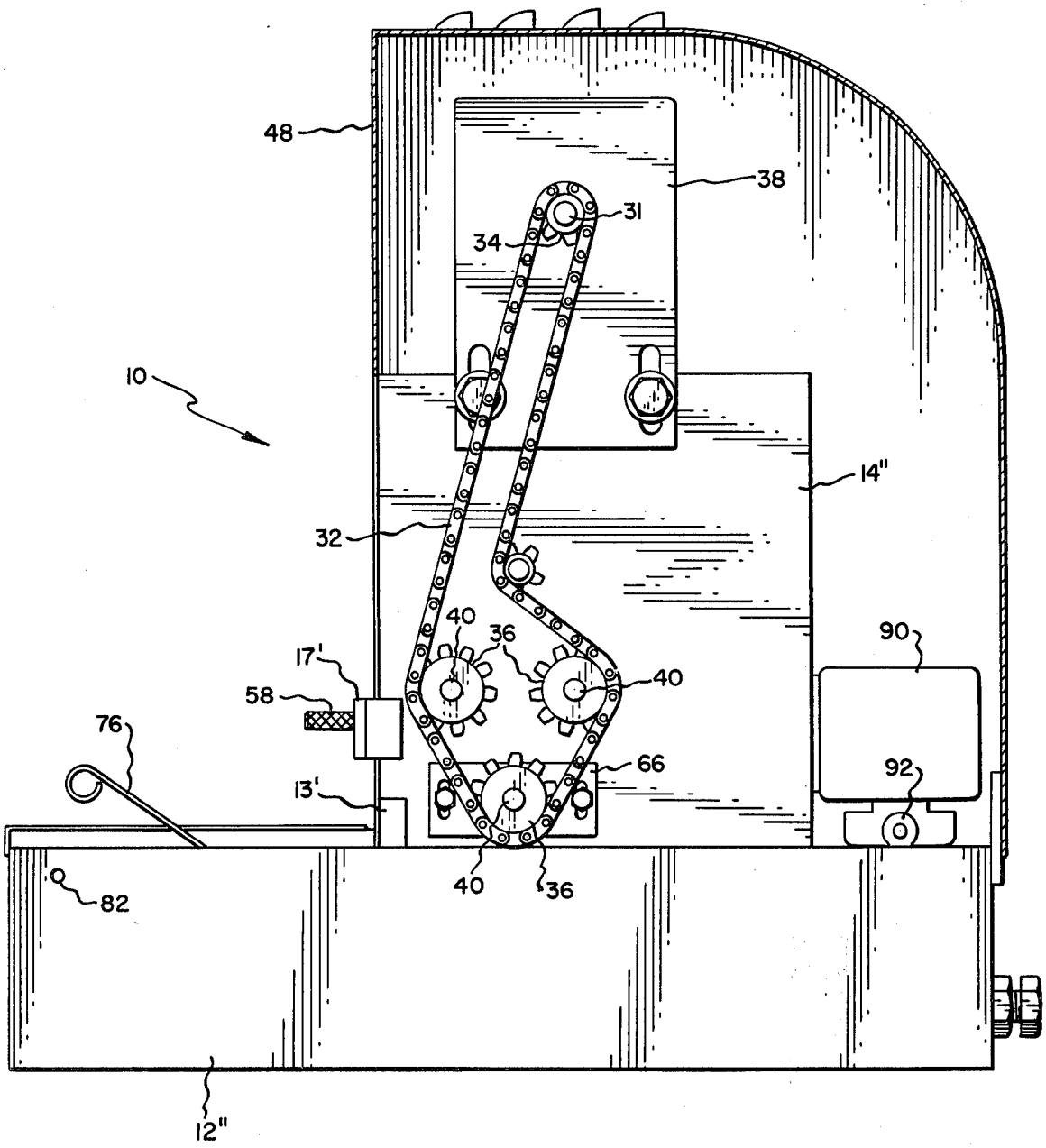
FIG. 3 is a side elevation of the rotary printer of the present invention taken along lines 3—3 of FIG. 2.

As best seen in FIG. 2, a number of independent annular printing cylinders 20 having circumferentially spaced printing facets 22 on their peripheries are rotationally mounted within the framework on the driven shafts 40. In the preferred embodiment, the three equally spaced driven shafts 40 pass through the central opening of the printing cylinders 20 and support the printing cylinders 20 for rotational motion by frictionally engaging the inside cylindrical surface 28 of the cylinders 20. As seen in FIG. 3, at least one of the shafts 40 and its mounting bearings 46',46" are adjustably mounted for adjustment toward or away from the axis of rotation of the printing cylinder 20. In this manner, adjustment of the position of the adjustable shaft can be made so as to exert an outwardly directed pressure which can be increased or decreased and which tends to positively support the printing cylinder.

Figure 4:
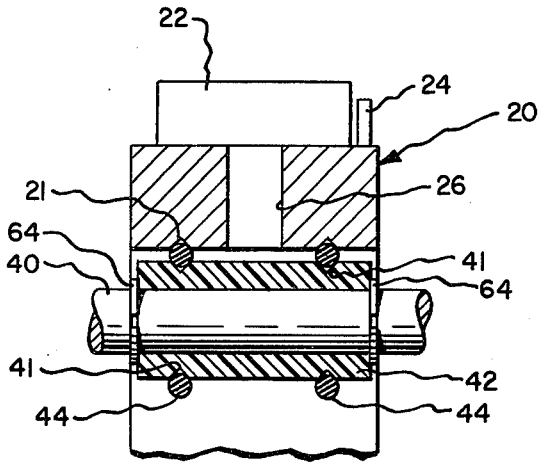
FIG. 4 is a cross-sectional view of one of the annular printing cylinders of the printing device showing a drive shaft and a friction engaging means frictionally connecting the drive shaft and the printing cylinder.

As best seen in FIG. 4, a friction means is provided which frictionally connects the driven shafts 40 and the printing cylinders 20 for imparting rotation to the cylinders 20. In the preferred embodiment, the friction means includes polyethelene roller disks 42 frictionally mounted on their respective driven shafts 40. These disks or rollers 42 carry rubber O-ring driving rims 44 which fit in facing angular grooves 41 and 21 in the roller disks 42 and printing cylinder 20 respectively. With the above described arrangement, when rotation of the printing cylinder 20 is unimpeded, friction between the driven shafts 40, rollers 42, O-ring driving rims 44 and the printing cylinder 20 is effective to cause the printing cylinders 20 to rotate around an axis parallel to the axes of the driven shafts 40. When the rotation of the printing cylinders 20 is impeded, slippage is permitted between the driven shafts 40 and the roller disks 42 so that the printing cylinders 20 may be held stationary with a desired printing facet 22 facing in the proper direction for its application against the surface to be printed.

In order to stop the rotation of the printing cylinders 20 in a proper orientation to permit the printing operation, each printing cylinder 20 is provided with a number of outwardly extending peripheral stop pins 24 which are equal in number to the number of printing facets 22 on the exterior periphery of the printing cylinders 20. As can be seen in FIGS. 1 and 2, cross bar 16" supports a solenoid support plate 52 which in turn supports a plurality of solenoids 50. Solenoids 50 are positioned immediately above some of the printing wheels 20 and are provided with solenoid extensions 54. Actuation of the solenoids 50 cause the extensions 54 to move toward the printing cylinders 20 resulting in an interference with the movement of pins 24. In this manner, rotation of the printing cylinders 20 is selectively prevented. The pins 24 are positioned such that engagement of each different pin results in a different type facet 22 pointing downward in the printing position.

As can be seen in FIG. 2, some of the printing cylinders 20' do not have corresponding solenoids 50 in order to prevent their rotational motion. Instead, the printing cylinders 20' are provided with slots or notches 62 therein which may be engaged by a manual set pin 58 in order to prevent their rotation. In this manner, printing cylinders 20' make available printing information which does not change for a given number of printing operations such as batch number, Julian date, or other identifying information. In contrast, printing cylinders 20 which include stop pins 24 and are associated with solenoids 50 are provided for printing information which varies from label to label such as a serial number or a weight.

Each of the printing cylinders 20 is provided with a number of index means 26 equal in number to the number of printing facets 22 carried on the periphery thereof. In the preferred embodiment, the index means 26 is a plurality of holes through the annular printing cylinder 20 so that an appropriately positioned sensor 60 mounted on tie bar 16'" is able to detect and count the passage of the index holes 26. One of the index holes 26' is larger than the others which permits a counting means to be able to determine a zero point in order that the counter may be reset. Whereas the photosensor and the index means described is the preferred arrangement, any device or arrangement which is able to sense the rotational position and generate a signal indicative of the rotational position of the printing cylinder 20 would be suitable.

As best seen in FIG. 1, one possible arrangement for the label printing device of the present invention includes a translatable carriage 70 having a push handle 76. Carriage 70 carries a platen upon which label 72 is placed and also carries an inking roller 74 arranged in such a manner that the downwardly facing type facet 22 is inked by the inking roller 24 when the carriage 70 is translated into a printing position under the printing wheels 20. Carriage 70 is mounted for reciprocation on rails or guide bars 78. Guide bars 78 are mounted at one end in rail support member 80 which in turn is pivotally mounted on pivot pin 82. The other end of guide rails 78 are mounted on back plate 88 which in turn is connected to a pair of end plates 96 and a support plate 94. The vertical position of end plates 96 may be adjustably determined by adjustment screw 98. Centrally positioned support plate 94 is connected to a lift link 92 which in turn is connected to a solenoid 90 mounted on tie bar 17". As may be recognized, reciprocation of lift solenoid 90 causes the support rails 78 to be vertically lifted at one end as they pivot around the pivot point determined by pivot pin 82. This motion vertically lifts the carriage 70 and presses the label 72 against the printing facets 22 of the printing cylinders 20 when the carriage is in its printing position.

A number of electrical interlocks are provided to properly synchronize the operation of the printing system so that none of the various rotating and moving parts are actuated at an inappropriate time. Consequently, switch 86 is positioned to detect when the carriage 70 is in its printing position. Switch 86 actuates the lift solenoid 90 only when the carriage 70 is in its printing position. Additionally, solenoid 100 is provided connected to a transversely moveable member or lock plate 108 which is mounted in slide bar 104. Lock plate 108 has a notch in the top which, when in a first position, permits the passage therethrough of downwardly projecting bar 106 carried by the carriage 70 and which when in a second position, prevents the passage of bar 106. Control circuitry is arranged to control the position of solenoid 100 and consequently lock plate 108 so that carriage lock bar 106 is trapped in a withdrawn position by lock plate 108 when any of the printing cylinders 20 are in motion. Solenoid 100 is actuated to cause lock plate 108 to release lock bar 106 only when all motion of the printing cylinders 20 have ceased.

Switch plate 102 and micro-switch 68 are provided to detect when carriage 70 is in its completely withdrawn position. Only under this circumstance will the control system permit the withdrawal of solenoid extension shafts 54 from their extended and printing cylinder rotation impeding position. In this manner, printing cylinders 20 are not permitted to resume their free rotation until the carriage 70 and consequently the label 72 have been removed to a withdrawn position where there is no possibility that the rotation of the printing cylinders 20 could cause an already printed or an unprinted label to be inadvertently marked.

Figure 5:
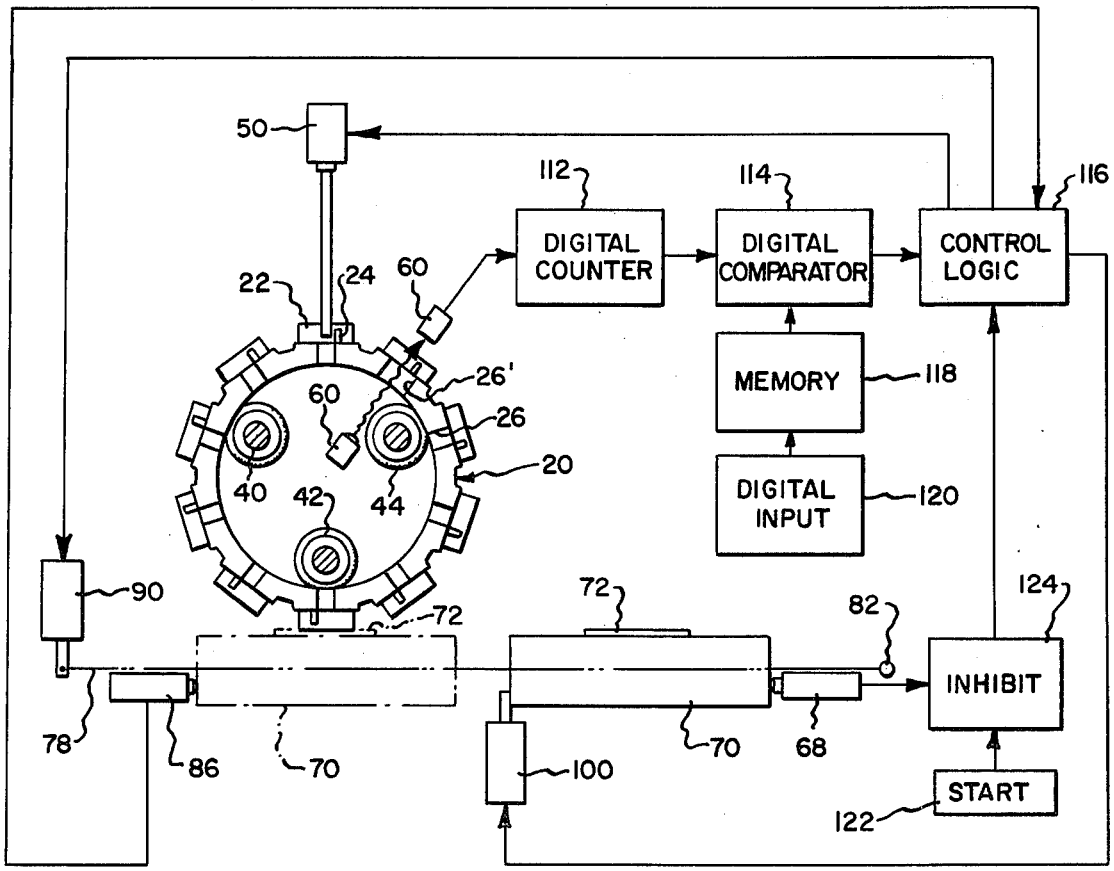
FIG. 5 is a semi-schematic representation of the electronic control system which controls the operation of the printing device of the present invention.

Referring now to FIG. 5, there appears a semi-diagrammatical circuit diagram of the control system itself. An input terminal 120 is provided to receive the desired information that the printer is directed to print. Input terminal 120 could be any commonly available interface device such as a number keyboard or a digital weighing scale. The input information is delivered to memory 118 which stores the information and makes it available to digital comparator 114. Digital comparator also received an index count from the digital counter 112 which is responsive to the signal generated by the phodetector system 60.

As previously described, photodetector system 60 generates a pulse at the passage of each of the index holes 26 in the printing cylinder 20. Out of the ten index holes, one of the index holes 26' is oversized so that a longer pulse is generated by photodetector system 60. Digital counter 112 is sensitive to the pulse length received and resets itself at zero each time the longer pulse is received. In this way, the photodetector system 60 and the digital counter 112 keep continuous track of the orientation of the printing cylinder 20 and consequently the positions of each of the printing facets 22. A digital signal is delivered from the digital counter 112 to the digital comparator 114 which compares the information from the digital input 120 with the counter signal. Only when the counter signal and the input signal match, is an actuation signal sent to control logic module 116 which in turn generates an actuation signal to be delivered to the appropriate solenoid 50. On receipt of this actuation signal, solenoid 50 is actuated and extension shaft 54 is caused to move into a stop pin 24 blocking positicn so that the rotational motion of the printing cylinder 20 is stopped with the desired printing facet in a downwardly facing printing position.

Control logic module 116 is also responsive to a signal derived from limit switch 86 as well as to a signal derived from a limit switch 104. Limit switch 104 indicates when the carriage 70 is in its completely withdrawn position. In such a case, a signal is delivered to inhibit circuitry 124 which is also responsive to a start button 122. Inhibit circuitry 124 generates a signal for delivery to the control logic 116 only when signals are being received both from the limit switch 102 and the start button 122. Control logic module 116 responds to this information to permit solenoids 50 to withdraw solenoid extension shafts 54 from engagement with the printing cylinders 20 only when both the start button 122 has been pressed and the carriage 70 is in its completely withdrawn position. Accordingly, an interlock is provided which prevents the inadverent rotation of the printing cylinders 20 when the carriage 70 is in any position other than its completely withdrawn position.

Additionally, control logic 116 is responsive to a signal generated by limit switch 86 indicative of the presence of the carriage 70 in the printing position. This signal is used as an interlock which permits the actuation of solenoid 90 which lifts the carriage 70 to cause the printing action only when the carriage 70 is in its fully inserted position.

Finally, control logic module 116 delivers a signal to solenoid 100 which controls the actuation of solenoid 100 in a manner which will not allow the carriage 70 to move until the printing cylinders 20 have all come to rest. Thus, solenoid 100, carriage lock bar 106, and lock plate 108 will not permit the insertion of the carriage 70 into the printing position while any of the printing cylinders 20 are in motion. The combination of these interlock systems and sensors assures that the label printer disclosed herein does not smudge or otherwise erroneously mark either a blank label as it is being inserted into its printing position or a printed label as it is being withdrawn from the printing position.

The mode of operation of the rotary printer described hereinabove is as follows. Input terminal 120 receives the appropriate printing information to be printed on label 72. The start button 122 is depressed and if the carriage 70 is in its fully withdrawn position as indicated by micro-switch 104, the control logic 116 permits the withdrawal of solenoid 50 so that all of the printing cylinders 20 begin to rotate due to their frictional engagement with the driving shafts 40. As they rotate, optical sensors 60 and digital counter 112 deliver the respective orientations of each of the printing cylinders 20 to digital comparator 114. As each of the printing cylinders 20 come to the desired orientation, digital comparator 114 produces a solenoid actuation signal which causes solenoid 50 to extend the solenoid extension shaft 54 into a position which prevents further cylinder rotation.

After all the freely rotating printing cylinders 20 have been brought to rest, indicating that the type facets in the downwardly facing printing position correspond to the information required by digital input 120, the control logic module 116 delivers a signal to solenoid 100 which causes solenoid 100 to move to a position which releases the carriage 70. Carriage 70 may then be manually pushed by means of push bar 76 into a printing position. As the carriage 70 is being pushed into the printing position, the inking roller 74 moves across the face of the downwardly facing type facets 22 to transfer ink thereto. As the carriage 70 reaches its inserted or printing position, limit switch 86 delivers a signal back to the control logic module 116 which in turn activates solenoid 90 so that the carriage 70 is lifted and the printing is accomplished.

Following the printing step, carriage 70 is manually withdrawn to its fully withdrawn position and a carriage withdrawn signal is once again generated by limit switch 104. Upon receipt of this signal, control logic 116 delivers an actuation signal to solenoid 100 which locks the carriage 70 in its withdrawn position while at the same time releasing the printing cylinders 20 for continued rotation.

What is claimed is:

1. An apparatus for printing articles, wherein the apparatus comprising:

(a) a structural framework;

(b) an annular printing cylinder mounted on said framework for rotation about its cylindrical axis, said printing cylinder having circumferentially spaced printing facets on its periphery;

(c) driving means mounted on said framework for providing a continuous driving force for continuously rotating said printing cylinder, said driving means including a plurality of substantially parallel driven shafts each mounted in a fixed position on said framework for rotation about its own axis and having its axis substantially parallel to the axis of rotation of said printing cylinder;

(d) friction means frictionally connecting each of said driven shafts and said printing cylinder for imparting rotation to said cylinder, said friction means permitting slippage between said driving means and said printing cylinder when the rotation of said cylinder is impeded;

(e) means responsive to the rotational position of said cylinder for impeding the rotation of said cylinder; and (f) means for producing relative motion between the object to be printed and said printing cylinder for bringing the object to be printed into contact with said printing cylinder.

2. The apparatus as recited in claim 1 wherein said means for bringing the object to be printed into contact with said printing cylinder includes a moveable platen which may be urged into printing relationship with the printing facets of said printing cylinder.

3. The apparatus as recited in claim 1 wherein each of said driven shafts pass through the central opening of said printing cylinder and wherein said friction means includes a disk mounted on each of said driven shafts, said disk including means for engaging the inside cylindrical surface of said printing cylinder.

4. The apparatus as recited in claim 3 wherein said disk has an "O" ring driving rim.

5. The apparatus as recited in claim 3 wherein said printing cylinder is supported for rotation about its axis by said driven shafts and said disks.

6. The apparatus as recited in claim 3 wherein said driven shafts are mounted with their axes of rotation laterally displaced from the axis of rotation of said printing cylinder and wherein said disks are rollers.

7. The apparatus as recited in claim 6 wherein said rollers are frictionally mounted on each shaft to permit slipping between said shaft and said roller when said roller is impeded in its rotation.

8. The apparatus as recited in claim 1 wherein said one of said plurality of driven shafts is radially adjustable relative to the axis of rotation of said printing cylinder.

9. The apparatus as recited in claim 1 wherein said means responsive to the rotational position of said cylinder for impeding the rotation of said cylinder includes a moveable member whereby reciprocation of said member moves said member into a cylinder engaging position for impeding the rotation of said cylinder.

10. The apparatus as recited in claim 9 wherein said printing cylinder includes circumferentially spaced outwardly extending stop pins adapted to be engaged by said moveable member.

11. The apparatus as recited in claim 1 wherein said printing cylinder includes a plurality of circumferentially spaced index means and wherein said means responsive to the rotational position of said cylinder for impeding the rotation of said cylinder includes scanning means responsive to said index means for generating a signal indicative of the rotational position of said printing cylinder.

12. The apparatus as recited in claim 11 wherein said index means includes index holes radially extending through a portion of said printing cylinder and wherein said means responsive to the rotational position of said cylinder for impeding the rotation of said cylinder includes a radially looking photocell scanning means responsive to said index holes for counting said index holes and for generating a signal indicative of the rotational position of said printing cylinder.

13. The apparatus as recited in claim 11 wherein said means responsive to the rotational position of said cylinder for impeding the rotation of said cylinder further includes input means for receiving printing information, means for storing said printing information, and control means responsive to said signal indicative of the rotational position of said printing cylinder and to said stored printing information for generating a control signal for actuating said means for impeding the rotation of said cylinder in a manner which stops the rotation of said printing cylinder in a position which places the correct printing facet in printing position corresponding to said input printing information.

14. The apparatus as recited in claim 2 further including means responsive to the position of said platen for preventing the rotation of said printing wheel unless said platen is in a withdrawn position.

15. The apparatus as recited in claim 2 further including means responsive to the rotation of said printing cylinder for preventing the movement of said platen while said printing cylinder is rotating.

16. The apparatus as recited in claim 9 wherein said printing cylinder includes a plurality of circumferentially spaced index means and wherein said means responsive to the rotational position of said cylinder for impeding the rotation of said cylinder includes scanning means responsive to said index means for generating a signal indicative of the rotational position of said printing cylinder.

17. The apparatus as recited in claim 2 wherein said index means includes index holes radially extending through a portion of said printing cylinder and wherein said means responsive to the rotational position of said cylinder for impeding the rotation of said cylinder includes a radially looking photocell scanning means responsive to said index holes for counting said index holes and for generating a signal indicative of the rotational position of said printing cylinder.

18. The apparatus as recited in claim 12 wherein the apparatus including a plurality of adjacent annular printing cylinders, each of which is independently driven by said continuously driven shaft.

* * * * *